US009176464B2

(12) United States Patent
Kwon et al.

(10) Patent No.: US 9,176,464 B2
(45) Date of Patent: Nov. 3, 2015

(54) PHOTORECEPTOR CARTRIDGE INCLUDING TWO ASSEMBLIES AND IMAGE FORMING APPARATUS HAVING THE SAME

(71) Applicant: Samsung Electronics Co., Ltd, Suwon-si, Gyeonggi-do (KR)

(72) Inventors: Se-il Kwon, Yongin-si (KR); Jae-rae Lee, Goyang-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/300,629

(22) Filed: Jun. 10, 2014

(65) Prior Publication Data

US 2015/0177682 A1 Jun. 25, 2015

(30) Foreign Application Priority Data

Dec. 19, 2013 (KR) ..... 10-2013-0159120

(51) Int. Cl.
*G03G 21/00* (2006.01)
*G03G 21/18* (2006.01)

(52) U.S. Cl.
CPC ..... *G03G 21/18* (2013.01); *G03G 21/0029* (2013.01); *G03G 21/1821* (2013.01)

(58) Field of Classification Search
CPC ..... G03G 21/18; G03G 21/00
USPC ..... 399/345, 111
See application file for complete search history.

(56) References Cited

U.S. PATENT DOCUMENTS

| | | | | |
|---|---|---|---|---|
| 4,284,345 | A | 8/1981 | Sugiyama et al. | |
| 4,791,454 | A | 12/1988 | Takahashi et al. | |
| 4,819,030 | A | 4/1989 | Shibano | |
| 8,270,890 | B2 | 9/2012 | Arai et al. | |
| 2008/0310896 | A1* | 12/2008 | Shono et al. | 399/350 |

(Continued)

FOREIGN PATENT DOCUMENTS

| | | |
|---|---|---|
| JP | 6-175551 | 6/1994 |
| JP | 7-230238 | 8/1995 |

(Continued)

OTHER PUBLICATIONS

International Search Report and Written Opinion of the International Searching Authority mailed Nov. 10, 2014 in International Patent Application No. PCT/KR2014/005158.
Extended European Search Report dated May 19, 2015 in corresponding European Patent Application No. 14179564.1.

*Primary Examiner* — Billy Lactaoen
(74) *Attorney, Agent, or Firm* — Staas & Halsey LLP

(57) ABSTRACT

A photoreceptor cartridge and an image forming apparatus having the photoreceptor cartridge. The photoreceptor cartridge includes: a first assembly configured to include a first frame and a photoreceptor that is installed at the first frame; a second assembly configured to include a second frame that is detachably combined with the first frame and a cleaning unit that is installed at the second frame and cleans a surface of the photoreceptor; at least one first pressing member configured to press the cleaning unit to the photoreceptor; and at least one second pressing member configured to press the cleaning unit into an opposite direction to a direction in which the first pressing member presses the cleaning unit.

18 Claims, 15 Drawing Sheets

(56) References Cited

U.S. PATENT DOCUMENTS

| | | | | |
|---|---|---|---|---|
| 2009/0190975 | A1 | 7/2009 | Thayer et al. | |
| 2011/0020041 | A1 | 1/2011 | Arai et al. | |
| 2011/0286763 | A1* | 11/2011 | Furubayashi et al. | 399/111 |
| 2012/0128378 | A1 | 5/2012 | Izumiya et al. | |

FOREIGN PATENT DOCUMENTS

| | | |
|---|---|---|
| JP | 8-314352 | 11/1996 |
| JP | 2000-122498 | 4/2000 |
| JP | 2013-242492 | 12/2013 |
| KR | 10-2011-000913 | 1/2011 |

* cited by examiner

PHOTORECEPTOR CARTRIDGE INCLUDING TWO ASSEMBLIES AND IMAGE FORMING APPARATUS HAVING THE SAME

CROSS-REFERENCE TO RELATED APPLICATIONS

This application claims priority under 35 U.S.C. §119 from Korean Patent Application No. 10-2013-0159120, filed on Dec. 19, 2013, in the Korean Intellectual Property Office, the disclosure of which is incorporated herein by reference in its entirety.

BACKGROUND OF THE INVENTION

1. Field of the Invention

The present general inventive concept generally relates to providing a photoreceptor cartridge and an image forming apparatus having the same, and more particularly, to providing a photoreceptor cartridge including two assemblies and an image forming apparatus having the same.

2. Description of the Related Art

In general, an image forming apparatus, such as a laser printer or the like using an electro-photographic printing method, includes a photoreceptor (for example, a photoconductive drum).

A toner image that reflects image data is developed on a surface of the photoreceptor and is directly or indirectly transferred onto a printing paper. After the toner image is completely transferred, toner remaining on the surface of the photoreceptor is cleaned by a cleaning unit having a cleaning blade.

The photoreceptor and the cleaning unit are formed into one assembly that is referred to as a photoreceptor cartridge, and then the photoreceptor cartridge is installed in an image forming apparatus. The photoreceptor cartridge may include a charging roller that charges the surface of the photoreceptor and a cleaning roller that cleans a surface of the charging roller.

If a lifespan of the cleaning blade is ended due to wear, etc., a method of replacing only the cleaning unit from the photoreceptor cartridge may be considered. However, operations of replacing only the cleaning unit and not the photoreceptor cartridge in which a plurality of parts are assembled is very complicated, and thus a large amount of repair and/or maintenance costs may be required for such operations.

Therefore, regarding conventional cartridges, if the lifespan of the cleaning blade is ended, the whole photoreceptor cartridge is replaced. In this case, the photoreceptor of which a lifespan is not ended is discarded together with the cleaning blade as well as other components of the photoreceptor cartridge.

SUMMARY OF THE INVENTION

Exemplary embodiments address at least the above problems and/or disadvantages as well as other disadvantages not described above. Also, the exemplary embodiments are not required to be limited to overcoming the disadvantages described above, and an exemplary embodiment may provide other features and utilities other than overcoming any of the problems described above.

The exemplary embodiments provide a photoreceptor cartridge that easily replaces some components including a cleaning blade and an image forming apparatus having the same.

Exemplary embodiments of the general inventive concept provide a photoreceptor cartridge including: a first assembly configured to include a first frame and a photoreceptor that is installed at the first frame; a second assembly configured to include a second frame that is detachably combined with the first frame and a cleaning unit that is installed at the second frame and cleans a surface of the photoreceptor; at least one first pressing member configured to press the cleaning unit to the photoreceptor; and at least one second pressing member configured to press the cleaning unit in an opposite direction to a direction in which the first pressing member presses the cleaning unit.

Pressure applied by the first pressing member may be higher than pressure applied by the second pressing unit.

The first pressing member may be a coil spring that is installed at the first frame, and the second pressing member may be a torsion spring that is installed at the second frame.

The second assembly may be installed at the first assembly to pivot between a first position to clean the photoreceptor and a second position to separate the second frame from the first frame.

The second frame may include a waste toner housing part into which waste toner removed from the photoreceptor by the cleaning unit flows.

The cleaning unit may be installed at the second frame to pivot between an open position to open the waste toner housing part and a closed position to close the waste toner housing part.

The cleaning unit may be disposed in the open position when the second assembly is in the first position and may be disposed in the closed position when the second assembly is in the second position.

When the second assembly is disposed in the first position, the first pressing member may press the cleaning unit into the open position, and the second pressing member may press the cleaning unit into the closed position.

The second frame may include a sealing member that seals the waste toner housing part.

The cleaning unit may be spaced apart from the sealing member in the open position and contact the sealing member in the closed position.

The second assembly may further include: a waste toner transfer auger configured to be installed in the waste toner housing part; and a waste toner transfer pipe configured to be installed at the second frame in order to discharge waste toner transferred from the waste toner housing part by the waste toner transfer auger.

The second frame may include two rotation protrusions, and the first frame may include two rotation protrusion insertion holes having rotation protrusion insertion grooves into which the rotation protrusions are inserted.

The rotation protrusions may have elliptical sections, and the rotation protrusion insertion grooves may have circular sections.

The cleaning unit may include: a bracket member configured to be installed at the second frame; and a cleaning blade configured to be combined with the bracket member.

The first assembly may further include: a charging roller configured to be installed at the first frame and charge the photoreceptor; and a cleaning roller configured to be installed at the first frame and clean the charging roller.

Exemplary embodiments of the general inventive concept also provide a photoreceptor cartridge including: a first assembly configured to include a photoreceptor; a second assembly configured to include a cleaning unit that cleans a surface of the photoreceptor and be detachably combined with the first assembly; at least one first pressing member configured to press the cleaning unit to the photoreceptor; and at least one second pressing member configured to press the cleaning unit into an opposite direction to a direction in which the first pressing member presses the cleaning unit, by using lower pressure than pressure applied by the first pressing member.

Exemplary embodiments of the general inventive concept also provide an image forming apparatus including a photoreceptor cartridge, the photoreceptor cartridge including: a first assembly configured to include a first frame and a photoreceptor that is installed at the first frame; a second assembly configured to include a second frame that is detachably combined with the first assembly and a cleaning unit that is installed at the second frame and cleans a surface of the photoreceptor; at least one first pressing member configured to press the cleaning unit to the photoreceptor; and at least one second pressing unit configured to press the cleaning unit into an opposite direction to a direction in which the first pressing member presses the cleaning unit.

Exemplary embodiments of the general inventive concept also provide an image forming apparatus including a photoreceptor cartridge, the photoreceptor cartridge including: a first assembly configured to include a photoreceptor; a second assembly configured to include a cleaning unit that cleans a surface of the photoreceptor and to be detachably combined with the first assembly; and at least one second pressing member configured to press the cleaning unit in an opposite direction to a direction in which a first pressing member presses the cleaning unit, by using lower pressure than pressure applied by the first pressing member. The second assembly may be installed at the first assembly to pivot between a first position for cleaning the photoreceptor through the cleaning unit and a second position for separating the second frame from the first frame.

Exemplary embodiments of the general inventive concept also provide a photoreceptor cartridge, comprising: a first frame including a photoreceptor and a first pressing member; and a second frame detachably and rotatably connected to the first frame and including a cleaning unit and a second pressing member, the cleaning unit being pressed in a first direction toward the photoreceptor by the first pressing member when the second frame is rotated toward the first frame and being pressed in a second direction opposite to the first direction by the second pressing member when the second frame is rotated away from the first frame.

In an exemplary embodiment, the first frame further includes a pair of rotation protrusion insertion grooves having rotation protrusion insertion holes therein to receive the second frame therein, and the second frame further includes a pair of rotation protrusions disposed at opposite sides thereof to be inserted through the respective ones of the rotation protrusion insertion grooves and into the rotation protrusion insertion holes of the first frame to attach and rotate the second frame with respect to the first frame.

In an exemplary embodiment, the first pressing member is a coil spring and the second pressing member is a torsion spring providing less force than the first pressing member.

In an exemplary embodiment, the cleaning unit further comprises: a waste toner housing part extending the length of the second frame; a sealing member extending the length of the photoconductor to seal toner in the waste toner housing part; and a cleaning blade connected to the cleaning unit and extending approximately equal to the length of the sealing member and the photoconductor such that when the second frame is rotated away from the first frame, the cleaning blade is rotated by the second pressing member to contact the sealing member to seal waste toner within the waste toner housing part.

In an exemplary embodiment, the rotation protrusion insertion grooves are disposed such that the rotation protrusions can slide into and out of the rotation protrusion insertion holes through the rotation protrusion insertion grooves when the second frame is rotated away from the first frame.

In an exemplary embodiment, the first frame further includes fastener combining holes at opposite ends thereof, and the second frame further includes fastener members at opposite ends thereof to be fastened to respective ones of the fastener combining holes when the second frame is rotated toward the first frame.

In an exemplary embodiment, the fastener members are screws and the fastener combining holes are screw combining holes.

Exemplary embodiments of the general inventive concept also provide a photoreceptor cartridge, comprising: a first frame including a photoreceptor; a second frame detachably and rotatably connected to the first frame and including a cleaning unit, the cleaning unit being rotatable in a first direction toward the photoreceptor when the second frame is rotated toward the first frame and being rotatable in a second direction opposite to the first direction when the second frame is rotated away from the first frame; and a pressure assembly configured to press the cleaning unit to rotate in the first direction when the second frame is rotated toward the first frame and to press the cleaning unit to rotate in the second direction when the second frame is rotated away from the first frame.

In an exemplary embodiment, the pressure assembly comprises a first pressing member configured as a coil spring extending from the first frame to press the cleaning unit of the second frame and a second pressing member configured as a torsion spring in the second frame and providing less force than the first pressing member

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
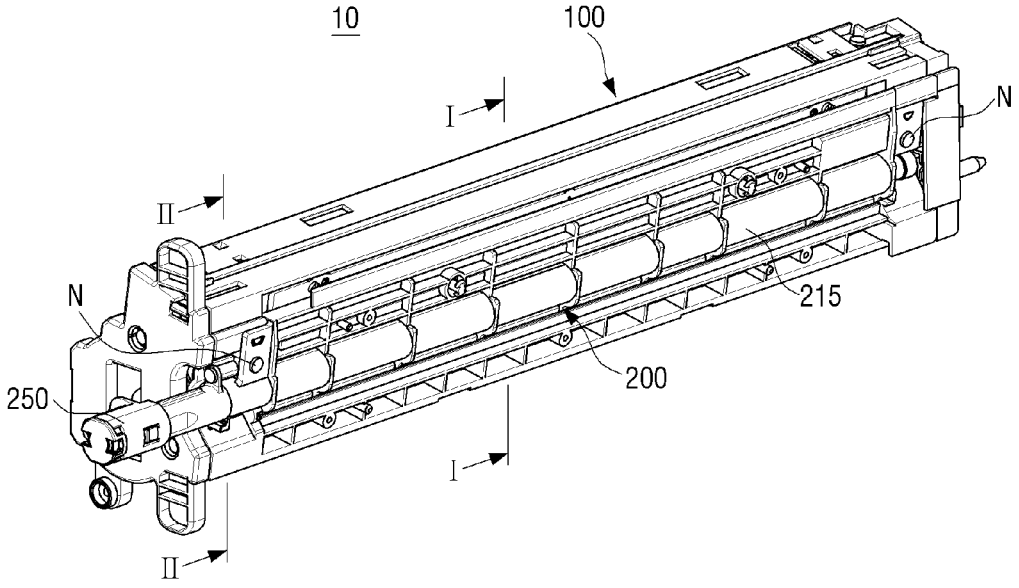
FIG. 1 is a perspective view of a photoreceptor cartridge according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

In the following description, the same drawing reference numerals are used for the same elements even in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, well-known functions or constructions are not described in detail since they would obscure the exemplary embodiments with unnecessary detail.

Figure 2:
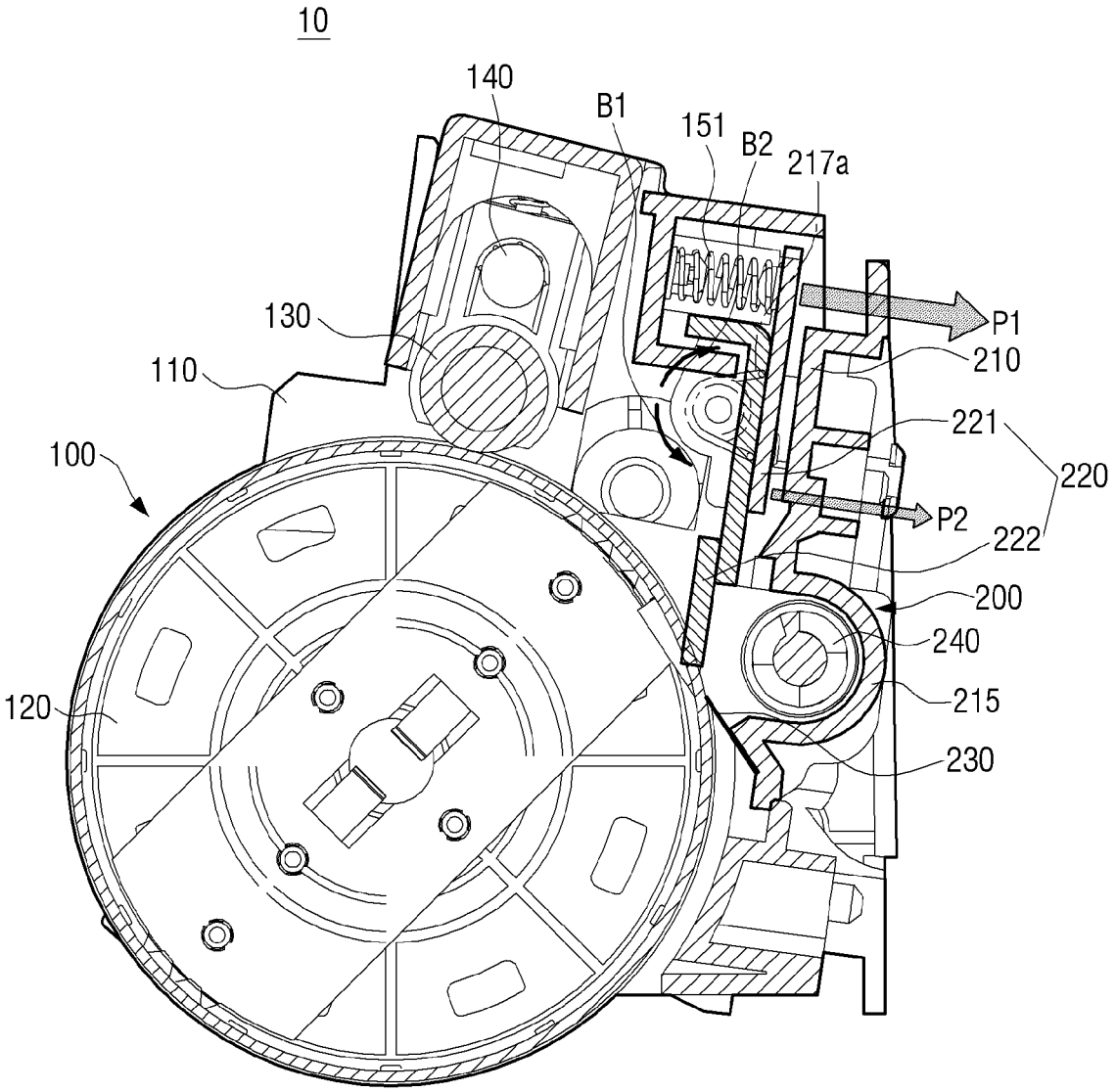
FIG. 2 is a cross-sectional view of the photoreceptor cartridge of FIG. 1 taken along line I-I of FIG. 1.
Figure 3:
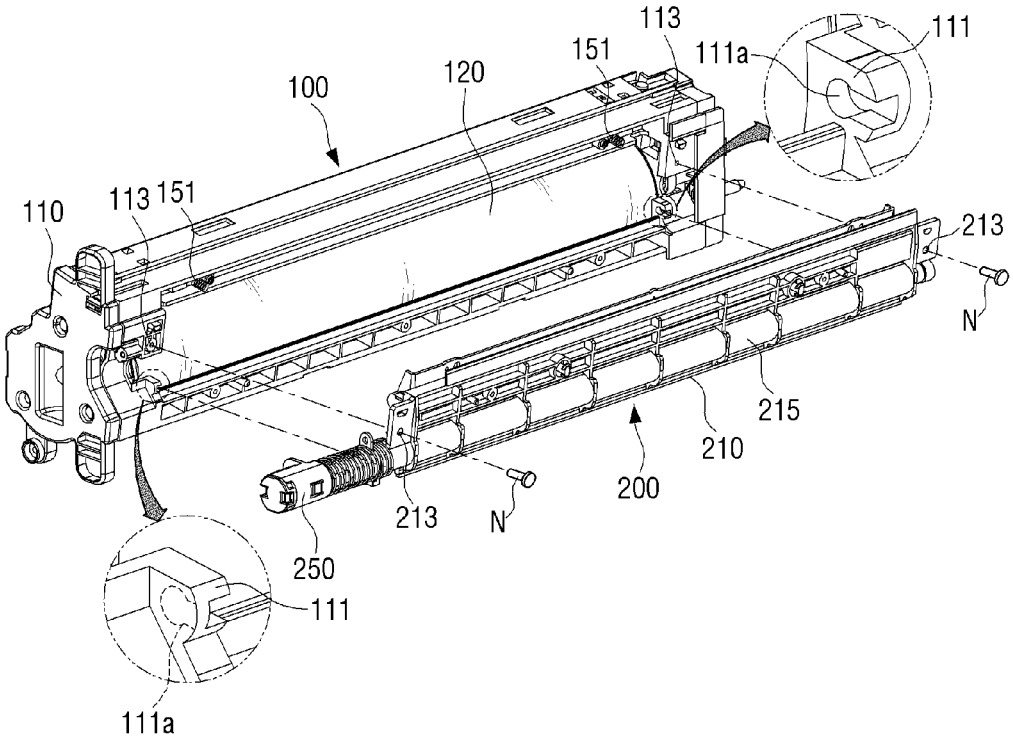
FIG. 3 is an exploded perspective view of the photoreceptor cartridge of FIG. 1 that is divided into first and second assemblies.
Figure 4:
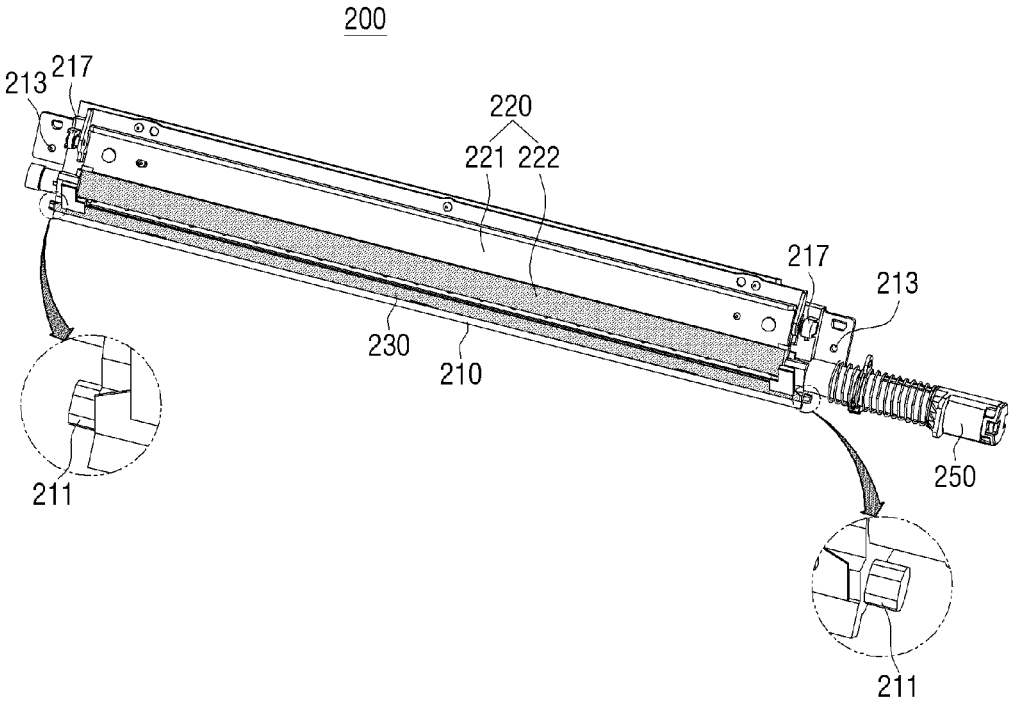
FIG. 4 is a perspective view of the second assembly of FIG. 3 seen on the other side.
Figure 5:
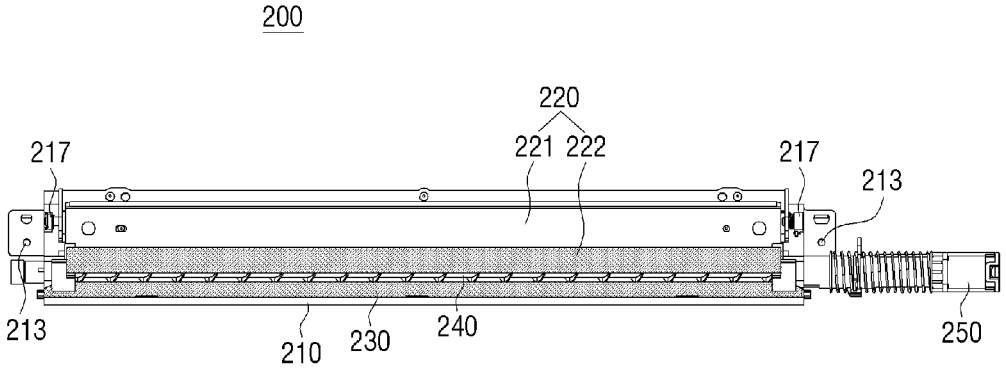
FIG. 5 is a plan view of the second assembly of FIG. 4.
Figure 6:
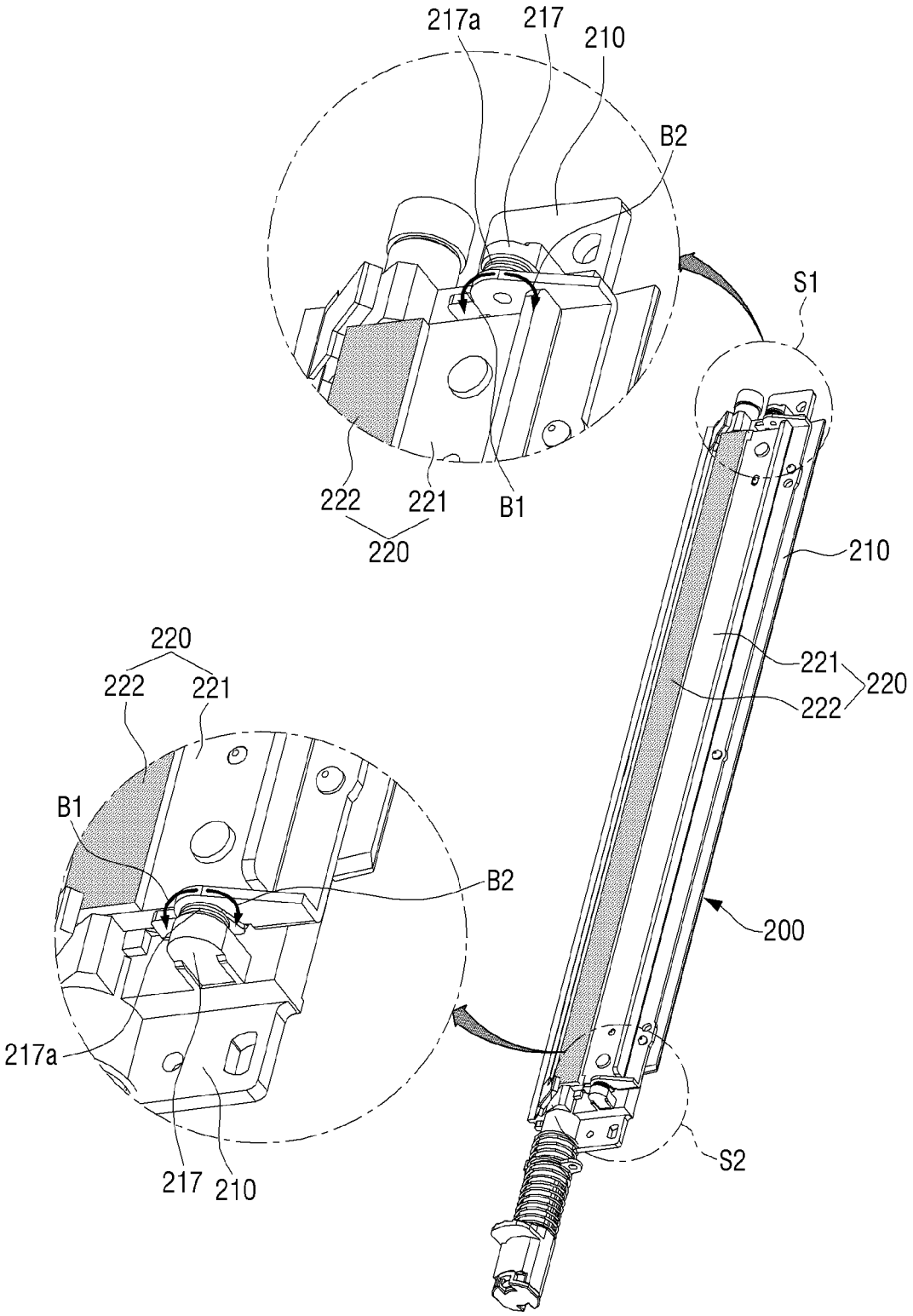
FIG. 6 is an enlarged perspective view of areas S1 and S2 of the second assembly of FIG. 3.
Figure 7A:
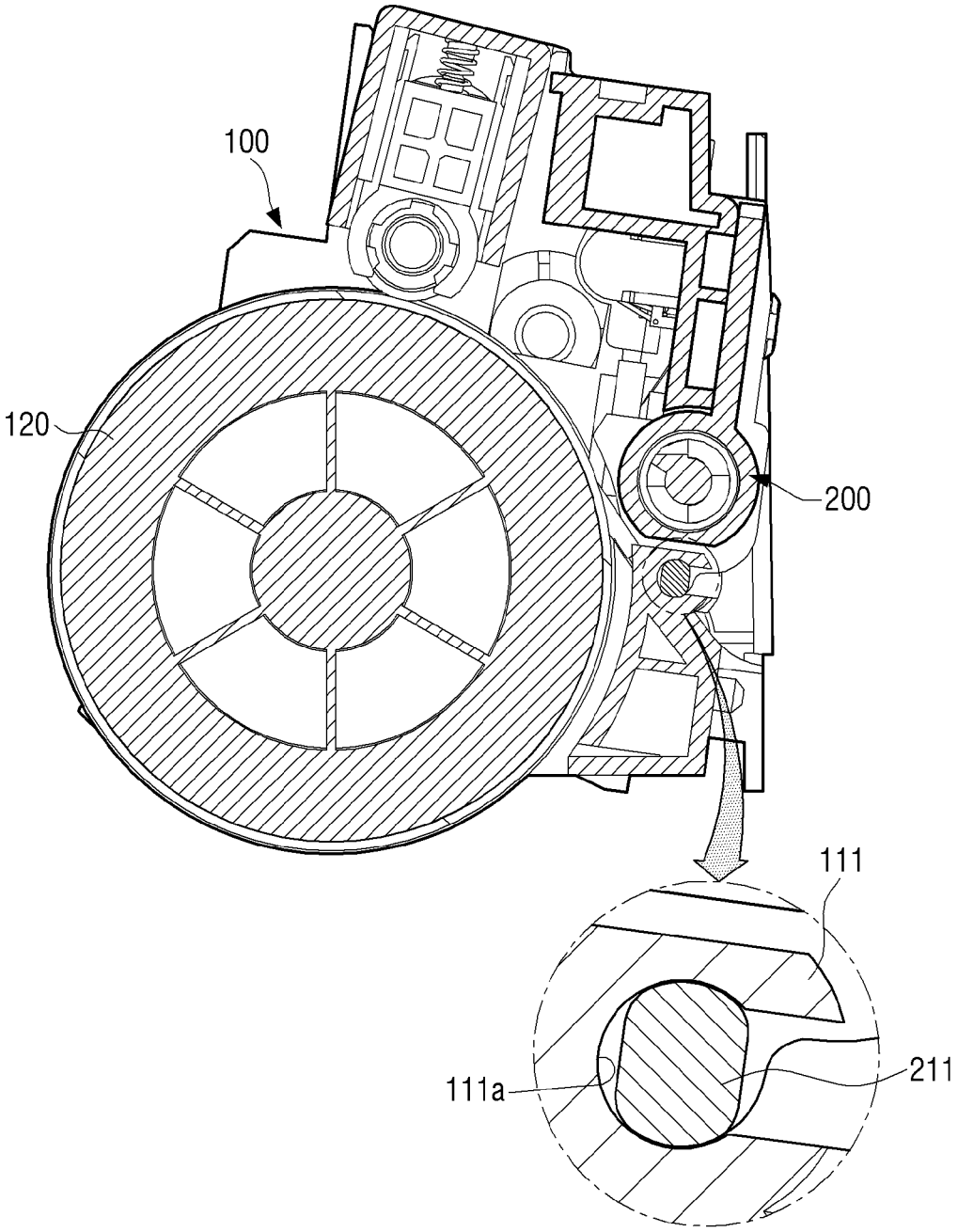
FIG. 7A is a cross-sectional view of the photoreceptor cartridge of FIG. 1 taken along line II-II of FIG. 1.
Figure 7B:
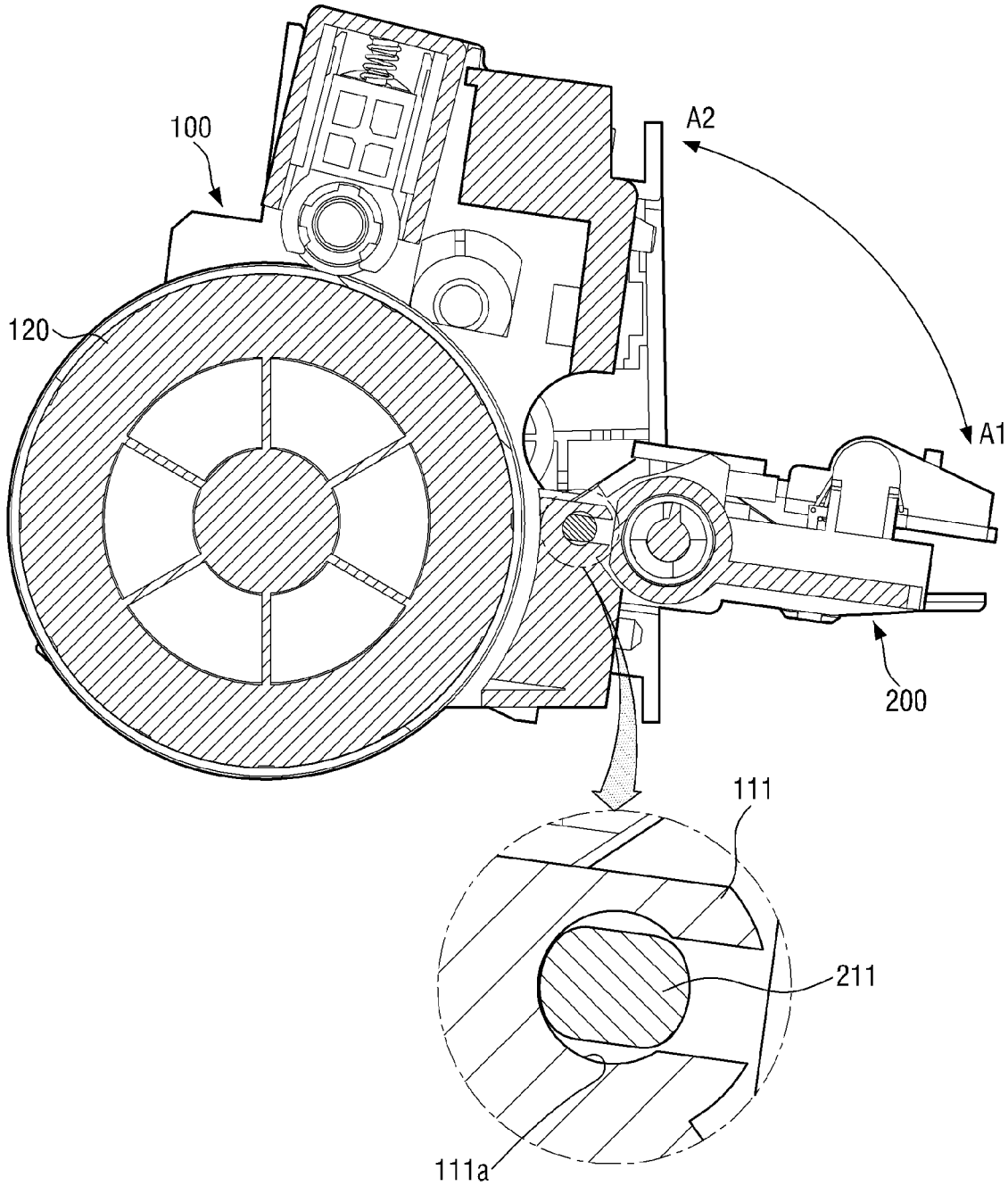
FIG. 7B is a cross-sectional view of the second assembly that pivots at 90° in a clockwise direction.

FIG. 1 is a perspective view of a photoreceptor cartridge 10 according to an exemplary embodiment of the present general inventive concept. FIG. 2 is a cross-sectional view of the photoreceptor cartridge 10 of FIG. 1 taken along line I-I of FIG. 1. FIG. 3 is an exploded perspective view of the photoreceptor cartridge 10 of FIG. 1 that is divided into first and second assemblies 100 and 200. FIG. 4 is a perspective view of the second assembly 200 of FIG. 3 seen on the other side. FIG. 5 is a plan view of the second assembly 200 of FIG. 4. FIG. 6 is an enlarged perspective view of areas S1 and S2 of the second assembly 200 of FIG. 3. FIG. 7A is a cross-sectional view of the photoreceptor cartridge 10 of FIG. 1 taken along line II-II of FIG. 1. FIG. 7B is a cross-sectional view of the second assembly 200 that pivots at 90° in a clockwise direction.

Referring to FIGS. 1 through 3, the photoreceptor cartridge 10 according to the present exemplary embodiment is installed and used in an image forming apparatus using an electro-photographic printing method. For example, the photoreceptor cartridge 10 may be applied to a laser printer, a copier, a multifunction peripheral (MFP), or the like.

The photoreceptor cartridge 10 includes the first assembly 100 and the second assembly 200.

The first assembly 100 includes a first frame 110, a photoreceptor 120, a charging roller 130, and a cleaning roller 140.

The first frame 110 has a structure that is separable from an image forming apparatus, and thus the first assembly 100 may be separated from the image forming apparatus. The first frame 110 respectively supports the photoreceptor 120, the charging roller 130, and the cleaning roller 140 that are installed at the first frame 110.

As shown in FIG. 3, the first frame 110 has two rotation protrusion insertion holes 111 into which the second assembly 200 is removably combined. The two rotation protrusion insertion holes 111 are spaced apart from each other by a distance corresponding to a length of the second assembly 200 and face each other. Rotation protrusion insertion grooves 111*a* are respectively formed in the rotation protrusion insertion holes 111 to provide for slidably removing and replacing the second assembly 200.

As shown in FIG. 3, two first pressing members 151 are installed at the first frame 110. In the present exemplary embodiment, the first pressing members 151 are installed as coil springs. Referring to FIG. 2, the first pressing members 151 apply first pressure P1 to the second assembly 200 that is combined with the first assembly 100. Functions performed by the first pressing members 151 will be described in more detail later.

The photoreceptor 120 is rotatably installed in the first frame 110 and is a photoconductive drum in the present exemplary embodiment. A toner image that will be transferred onto a printing paper is formed on a surface of the photoreceptor 120 in a printing process.

The charging roller 130 charges the surface of the photoreceptor 120 with a particular potential, and the cleaning roller 140 cleans a surface of the charging roller 130.

The second assembly 200 is detachably installed at the first assembly 110 to clean the surface of the photoreceptor 120 installed in the first frame 100. In detail, the second assembly 200 scrapes remaining toner from the surface of the photoreceptor 120 to clean the surface of the photoreceptor 120.

Referring to FIGS. 2 through 6, the second assembly 200 includes a second frame 210, a cleaning unit 220, a sealing member 230, a waste toner transfer auger 240, and a waste toner transfer pipe 250.

The second frame 210 is detachably installed on the first frame 110 of the first assembly 100. As shown in FIG. 4, the second frame 210 includes two rotation protrusions 211. As shown in FIG. 7A, the rotation protrusions 211 are respectively inserted into the rotation protrusion insertion grooves 111*a* of the rotation protrusion insertion holes 111. As shown in FIG. 7B, when the rotation protrusions 211 are inserted into the rotation protrusion insertion grooves 111*a*, the second assembly 200 may pivot in direction A1 or A2 based on the rotation protrusions 211.

Referring to FIGS. 7A and 7B, the rotation protrusion insertion grooves 111*a* have approximately circular sections, and the rotation protrusions 211 have approximately elliptical sections. Therefore, if the second assembly 200 is disposed in a first position to clean the surface of the photoreceptor 120 as shown in FIG. 7A, the rotation protrusions 211 are not separated from the rotation protrusion insertion grooves 111*a*. If the second assembly 200 pivots at 90° in the direction A1 to be disposed in a second position as shown in FIG. 7B, the rotation protrusions 211 can be separated from the rotation protrusion insertion grooves 111*a* by sliding the rotation protrusions 211 through the rotation protrusion insertion grooves 111*a* and away from the rotation protrusion insertion holes 111.

Referring to FIG. 3, two screw combining holes 113 into which two screws N can be combined are formed in the first frame 110, and two screw through-holes 213 through which the screws N pass through are formed in the second frame 210. As shown in FIGS. 1 and 7A, when the second assembly 200 is in the first position to perform a cleaning function, the first and second frames 110 and 210 are combined with each other by the two screws N combining with respective ones of the screw combining holes 113. Therefore, the second assembly 200 may be stably kept in the first position to perform the cleaning function. If the second assembly 200 pivots in the second position in which the second assembly 200 may be separated from the first assembly 100 as shown in FIG. 7B, the two screws N are first separated from the screw combining holes 113. The screws N can be provided in any form of a fastening member which simply and easily fastens and releases the combining of the first frame 110 and the second frame 210 while the second assembly 200 is in the first position.

Referring to FIGS. 1 through 3, a waste toner housing part 215 is formed in the second frame 210, has an approximately semicircular section, and extends along a longitudinal direction of the second frame 210. When the second assembly 200 is disposed in the first position to perform the cleaning function as shown in FIG. 2, the waste toner housing part 215 is disposed to face the photoreceptor 120. Therefore, waste toner that is removed from the surface of the photoreceptor 120 by the cleaning unit 220 may flow into the waste toner housing part 215.

Referring to FIGS. 2 and 6, the cleaning unit 220 includes a bracket member 221 that is pivotably installed at the second frame 210 and a cleaning blade 222 that is combined with a front end of the bracket member 221.

As shown in FIG. 6, the second frame 210 includes a pair of bracket support parts 217. The bracket member 221 is pivotably combined with the bracket support parts 217 to pivot in forward direction B1 (see FIG. 2) or backward direction B2 (see FIG. 2). Second pressing members 217*a* that apply pressure following the forward direction B1 are respectively installed at the bracket support parts 217. In the present exemplary embodiment, the second pressing members 217*a* are torsion springs.

Referring to FIG. 2, when the first and second assemblies 100 and 200 are combined with each other, the bracket member 221 receives first pressure P1 following the backward direction B2 from the first pressing members 151 and receives second pressure P2 following the forward direction B1 from the second pressing members 217*a*.

The first pressure P1 applied by the first pressing members 151 is set to be greater than the second pressure P2 applied by the second pressing members 217*a*. Therefore, when the second assembly 200 is in the first position to perform the cleaning function of the photoreceptor 120 as shown in FIG. 2, the cleaning unit 220 pivots in the backward direction B2 by the first pressure P1 to be disposed in a position (an open position) to open the waste toner housing part 215 in order to allow remaining toner to flow from the photoreceptor 120 into the waste toner housing part 215. When the cleaning unit 220 is disposed in the open position as described above, the cleaning blade 222 contacts the surface of the photoreceptor 120 while creating a gap between the cleaning blade 222 and the sealing member 230.

If the second assembly 200 pivots in the direction A1 to be disposed in the second position to separate the second assembly 200 from the first assembly 100 as shown in FIG. 7B or the second assembly 200 is fully separated from the first assembly 100 as shown in FIG. 3, the first pressure P1 applied by the first pressing members 151 is not applied to the cleaning unit 220. Therefore, the cleaning unit 220 pivots in the forward direction B1 by the second pressure P2 to be disposed in a position (a closed position) to close the waste toner housing part 215. When the cleaning unit 220 is disposed in the closed position as described above, the cleaning blade 222 of the cleaning unit 220 contacts the sealing member 230 such that toner cannot escape from the waste toner housing part 215.

Referring to FIGS. 3 and 4, the sealing member 230 is installed at the second frame 210 to be parallel with the cleaning blade 222. A length of the sealing member 230 is approximately equal to a length of the cleaning blade 222. When the cleaning unit 220 is disposed in the closed position, the cleaning blade 222 contacts the sealing member 230 that is disposed under the cleaning blade 222 so that there exists no gap therebetween. Therefore, waste toner existing in the waste toner housing part 215 cannot flow out of the waste toner housing part 215 through a gap between the cleaning blade 222 and the sealing member 230.

Referring to FIGS. 2 and 5, the waste toner transfer auger 240 is rotatably installed in the waste toner housing part 215. The waste toner transfer auger 240 transfers the waste toner, which flows into the waste toner housing part 215 from the photoreceptor 120, into the waste toner transfer pipe 250. The waste toner transfer pipe 250 is installed at an end of the second frame 210 to be connected to the waste toner housing part 215 in order to transfer the waste toner, which is transferred from the waste toner housing part 215, into a waste toner container installed in an image forming apparatus.

Processes of separating the first and second assemblies 100 and 200 of the photoreceptor cartridge 10 from each other will now be described with reference to FIGS. 8A, 8B, 9A, 9B, 10A, and 10B.

Figure 8A:
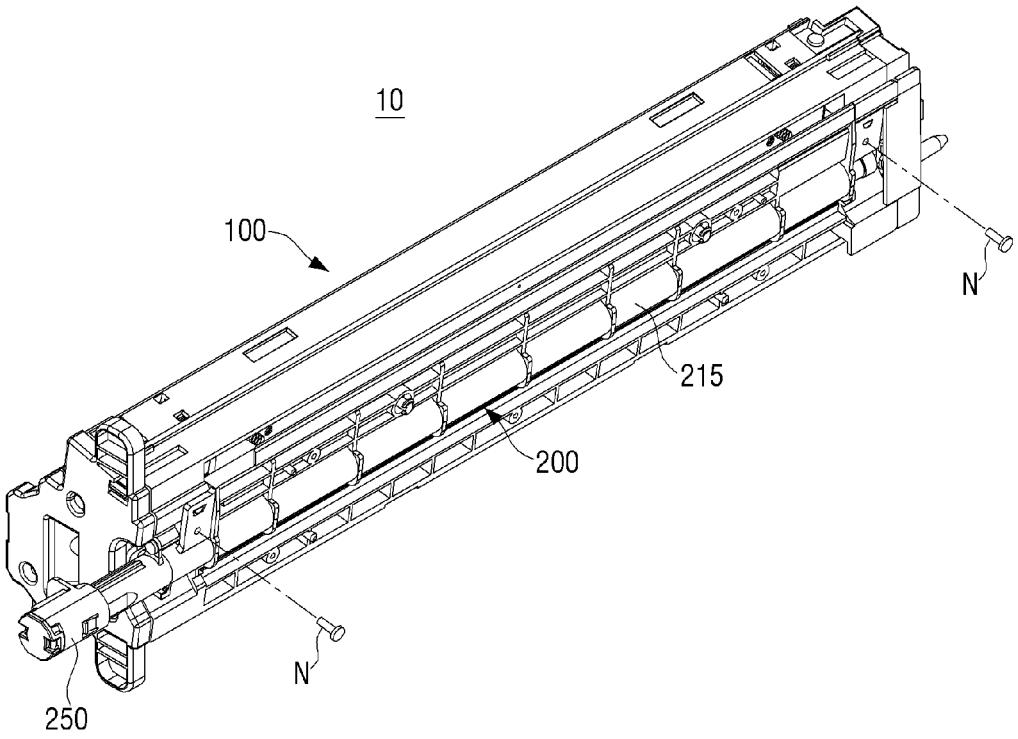
FIG. 8A is a perspective view illustrating a process of separating screws from the photoreceptor cartridge.
Figure 8B:
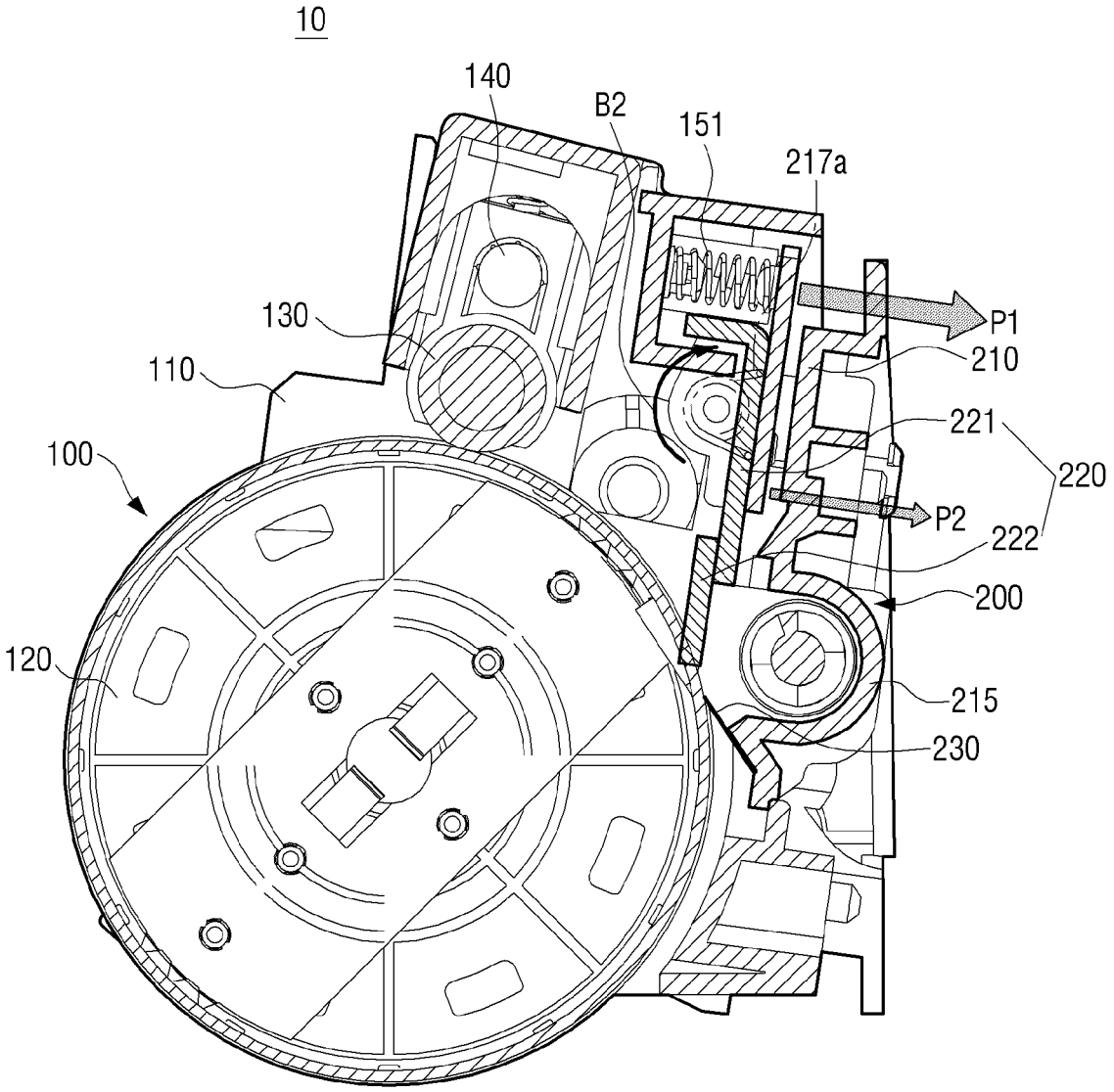
FIG. 8B is a cross-sectional view corresponding to the perspective view of FIG. 8A.
Figure 9A:
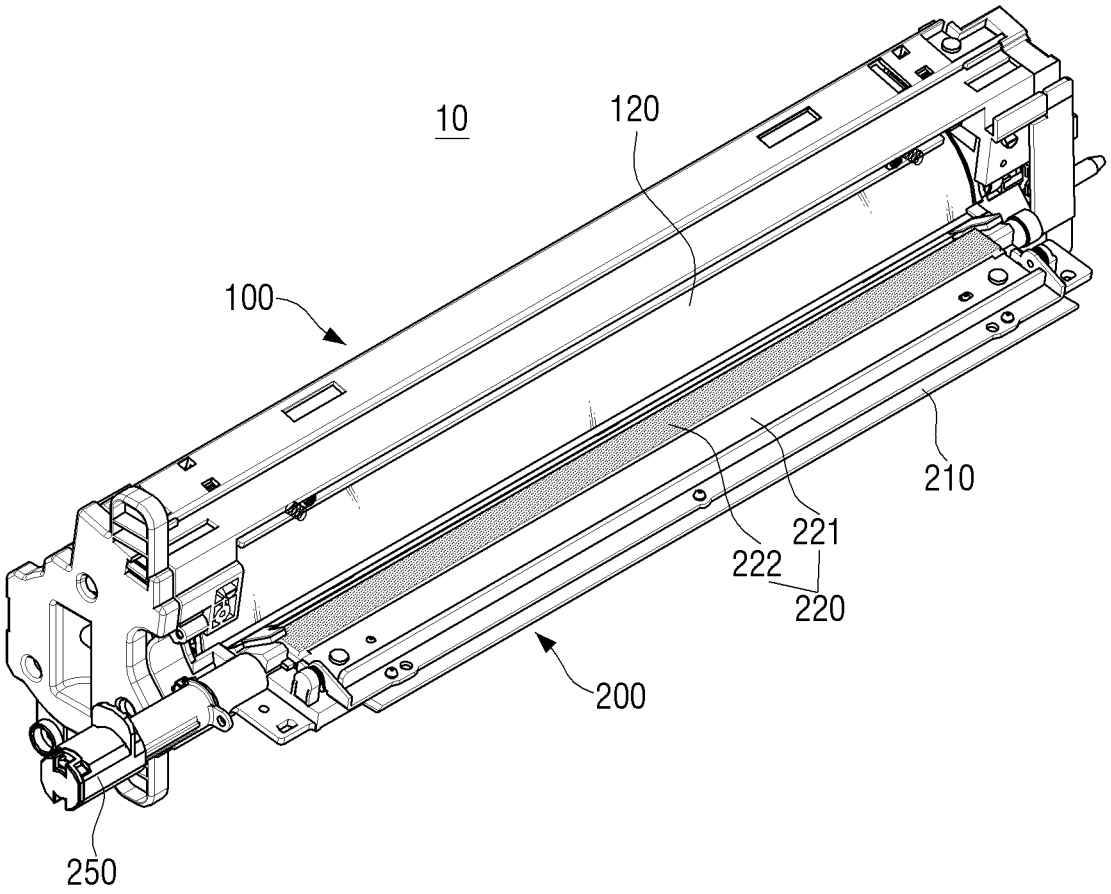
FIG. 9A is a perspective view illustrating a process of rotating the second assembly of the photoreceptor cartridge from a first position (a cleaning performing position) to a second position (a separable position)
Figure 9B:
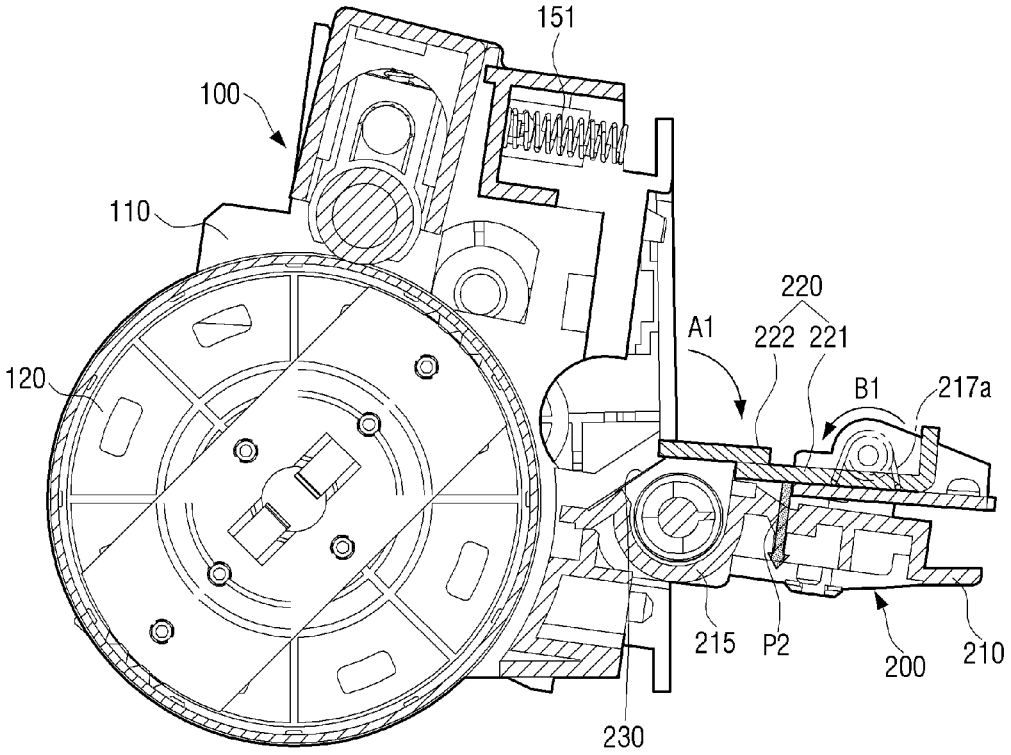
FIG. 9B is a cross-sectional view corresponding to the perspective view of FIG. 9A.
Figure 10A:
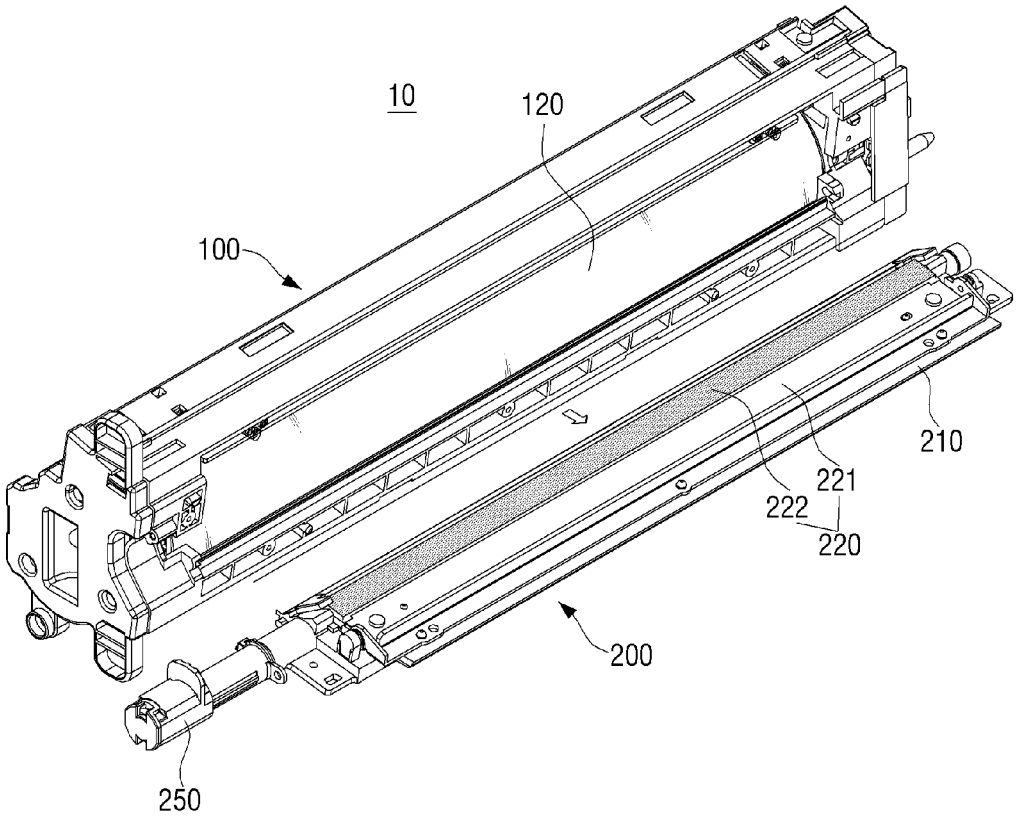
FIG. 10A is a perspective view illustrating a process of separating the second assembly from the first assembly.
Figure 10B:
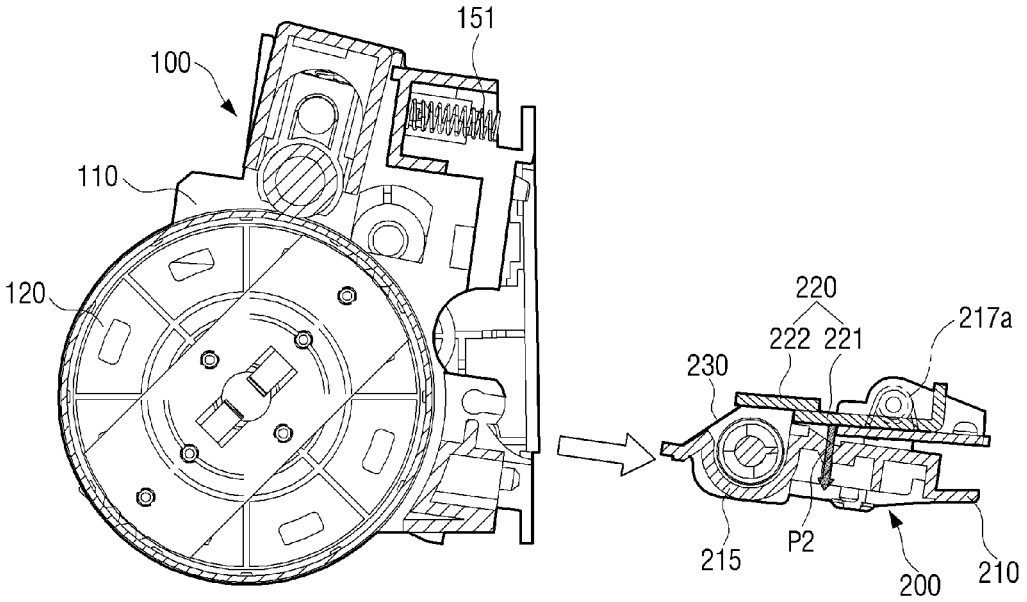
FIG. 10B is a cross-sectional view corresponding to the perspective view of FIG. 10A.

FIG. 8A is a perspective view illustrating a process of separating screws from the photoreceptor cartridge 10. FIG. 8B is a cross-sectional view corresponding to the perspective view of FIG. 8A. FIG. 9A is a perspective view illustrating a process of pivoting the second assembly 200 of the photoreceptor cartridge 10 from a first position (a cleaning performance position) to a second position (a separable position). FIG. 9B is a cross-sectional view corresponding to the perspective view of FIG. 9A. FIG. 10A is a perspective view illustrating a process of separating the second assembly 200 from the first assembly 100. FIG. 10B is a cross-sectional view corresponding to the perspective view of FIG. 10A.

Referring to FIGS. 8A and 8B, screws N that combine the first and second assemblies 100 and 200 with each other are separated from the photoreceptor cartridge 10. Here, the second assembly 200 is disposed in the first position to clean the photoreceptor 120, and the cleaning unit 220 of the second assembly 200 is disposed in an open position to open the waste toner housing part 215 (creating a gap between the cleaning blade 222 and the sealing member 230) by the first pressure P1 applied by the first pressing members 151. Here, the cleaning blade 222 of the cleaning unit 220 keeps a contact with the surface of the photoreceptor 120.

Referring to FIGS. 9A and 9B, the second assembly 200 pivots at about 90° in the direction A1 to be disposed in the second position to separate the second assembly 200 from the first assembly 100. If the second assembly 200 is moved into the second position as described with reference to FIG. 7B, the rotation protrusions 211 of the second assembly 200 may be separated from the rotation protrusion insertion grooves 111*a* of the first assembly 100.

When the second assembly 200 is moved into the second position, the first pressure P1 applied by the first pressing members 151 is no longer applied to the cleaning unit 220, but the second pressure P2 applied by the second pressing members 217*a* is applied to the cleaning unit 220. Therefore, the cleaning unit 220 pivots in the forward direction B1 (see FIGS. 2 and 9B) by the second pressure P2, and thus the cleaning blade 222 contacts the sealing member 230 to be disposed in the closed position to close the waste toner housing part 215. Since the waste toner housing part 215 is closed in a process of moving the second assembly 200 into the second position, the waste toner housed in the waste toner housing part 215 may be prevented from flowing out of the waste toner housing part 215.

Referring to FIGS. 10A and 10B, the second assembly 200 is pulled along a direction indicated by an arrow (FIG. 10B) to be separated from the first assembly 100. Although the second assembly 200 is separated from the first assembly 100, the cleaning unit 220 is kept in the closed position to close the waste toner housing part 215 by the second pressing members 217*a*. Therefore, the waste toner may be prevented from flowing out of the waste toner housing part 215 in a process of transferring the separated cleaning unit 220.

If a lifespan of the photoreceptor 120 continues while a lifespan of the cleaning blade 222 is ended, the second assembly 200 may be simply separated from the first assembly 100 through the above-described separating process. Therefore, only the second assembly 200 in which the cleaning blade 222 is installed may be easily discarded. Also, a new second assembly 200 may be combined with the first assembly 100 in a reverse process of the separating process to continue to use the photoreceptor 120 for the photoreceptor's full lifespan.

In the photoreceptor cartridge 10 according to the present exemplary embodiment, only the second assembly 200 in which the cleaning blade 222 is installed may be simply separated and replaced. Therefore, although the lifespan of the cleaning blade 222 is ended, the whole photoreceptor cartridge 10 is not required to be discarded, and thus a usage of the full lifespan of the photoreceptor 120 can be guaranteed. Also, the second assembly 200 may be simply separated from the first assembly 100 in the above-described three-level process, and thus may be replaced at a relatively low service cost.

Figure 11:
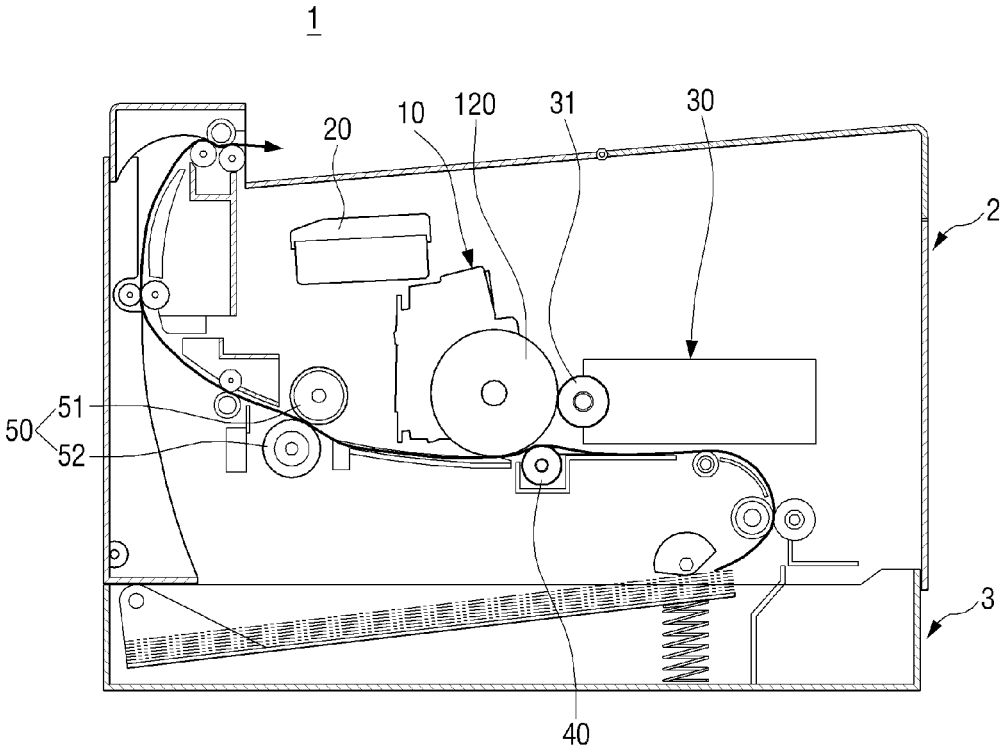
FIG. 11 is a schematic view illustrating an image forming apparatus according to an exemplary embodiment of the present general inventive concept.

FIG. 11 is a schematic view illustrating an image forming apparatus 1 according to an exemplary embodiment of the present general inventive concept.

Referring to FIG. 11, the image forming apparatus 1 may be a laser printer. However, the image forming apparatus 1 is not limited to the laser printer and may be equally applied to other types of image forming apparatuses such as a copier, a fax machine, a multifunction peripheral (MFP), etc.

The image forming apparatus 1 includes a main body 2 and a paper feeding unit 3 that is detachably combined with a lower end of the main body 2. A plurality of printing papers on which printing will be performed are housed in the paper feeding unit 3, and printing is performed on the printing papers, which are picked up from the paper feeding unit 3, in the main body 2.

The main body 2 of the image forming apparatus 1 includes the photoreceptor cartridge 10, an exposing unit 20, a developing cartridge 30, a transfer unit 40, and a fixing unit 50.

In a printing process, an electrostatic latent image that reflects printing data is formed on the surface of the photoreceptor 120 of the photoreceptor cartridge 10 by a laser beam irradiated from the exposing unit 20. The electrostatic latent image is developed into a toner image by a developing roller 32 of the developing cartridge 30.

When a printing paper passes through a nip formed between the photoreceptor 120 and the transfer unit 40, the toner image formed on the photoreceptor 120 is transferred onto a printing paper. As shown in FIG. 11, the transfer unit 40 is installed as a transfer roller. The fixing unit 50 includes a pressing roller 51 and a pressing roller 52 to fix the toner image, which is transferred on the printing paper, through heat and pressure.

The photoreceptor cartridge 10 including the first and second assemblies 100 and 200 is used as the photoreceptor cartridge 10 of the image forming apparatus 1.

Therefore, if the lifespan of the cleaning blade 222 is ended as described above, the second assembly 200 in which the cleaning blade 22 is installed may be simply replaced without discarding the whole photoreceptor cartridge 10. Therefore, use of the full lifespan of the photoreceptor 120 may be guaranteed. Also, the second assembly 200 may be simply separated from the first assembly 100 through the above-described three-level process, and thus may be replaced at a relatively low service cost.

The foregoing exemplary embodiments and utilities of the general inventive concept are merely exemplary and are not to be construed as limiting. The present teachings can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A photoreceptor cartridge comprising:

a first assembly configured to comprise a first frame and a photoreceptor that is installed at the first frame;

a second assembly configured to comprise a second frame that is detachably combined with the first frame and a cleaning unit that is installed at the second frame and cleans a surface of the photoreceptor;

at least one first pressing member configured to press the cleaning unit to the photoreceptor; and at least one second pressing member configured to press the cleaning unit in an opposite direction to a direction in which the first pressing member presses the cleaning unit, wherein the second assembly is installed at the first assembly to pivot between a first position to clean the photoreceptor through the cleaning unit and a second position to separate the second frame from the first frame.

2. The photoreceptor cartridge of claim 1, wherein pressure applied by the first pressing member is higher than pressure applied by the second pressing unit.

3. The photoreceptor cartridge of claim 1, wherein the first pressing member is a coil spring that is installed at the first frame, and the second pressing member is a torsion spring that is installed at the second frame.

4. The photoreceptor cartridge of claim 1, wherein the second frame comprises a waste toner housing part into which waste toner removed from the photoreceptor by the cleaning unit flows.

5. The photoreceptor cartridge of claim 4, wherein the cleaning unit is installed at the second frame to pivot between an open position to open the waste toner housing part and a closed position to close the waste toner housing part.

6. The photoreceptor cartridge of claim 5, wherein the cleaning unit is disposed in the open position when the second assembly is in the first position and is disposed in the closed position when the second assembly is in the second position.

7. The photoreceptor cartridge of claim 5, wherein when the second assembly is disposed in the first position, the first pressing member presses the cleaning unit toward the open position, and the second pressing member presses the cleaning unit toward the closed position.

8. The photoreceptor cartridge of claim 5, wherein the second frame comprises a sealing member that seals the waste toner housing part.

9. The photoreceptor cartridge of claim 8, wherein the cleaning unit is spaced apart from the sealing member in the open position and contacts the sealing member in the closed position.

10. The photoreceptor cartridge of claim 4, wherein the second assembly further comprises:

a waste toner transfer auger configured to be installed in the waste toner housing part; and a waste toner transfer pipe configured to be installed at the second frame in order to discharge waste toner transferred from the waste toner housing part by the waste toner transfer auger.

11. The photoreceptor cartridge of claim 1, wherein the cleaning unit comprises:

a bracket member configured to be installed at the second frame; and a cleaning blade configured to be combined with the bracket member.

12. The photoreceptor cartridge of claim 1, wherein the first assembly further comprises:

a charging roller configured to be installed at the first frame and charge the photoreceptor; and a cleaning roller configured to be installed at the first frame and clean the charging roller.

13. A photoreceptor cartridge comprising:

a first assembly configured to comprise a photoreceptor;

a second assembly configured to comprise a cleaning unit that cleans a surface of the photoreceptor and be detachably combined with the first assembly;

at least one first pressing member configured to press the cleaning unit toward the photoreceptor; and at least one second pressing member configured to press the cleaning unit toward an opposite direction to a direction in which the first pressing member presses the cleaning unit, by using less pressure than pressure applied by the first pressing member, wherein the second assembly is installed at the first assembly to pivot between a first position to clean the photoreceptor through the cleaning unit and a second position to separate the second frame from the first frame.

14. An image forming apparatus comprising a photoreceptor cartridge:

wherein the photoreceptor cartridge comprises:

a first assembly configured to comprise a first frame and a photoreceptor that is installed at the first frame;

a second assembly configured to comprise a second frame that is detachably combined with the first assembly and a cleaning unit that is installed at the second frame and cleans a surface of the photoreceptor;

at least one first pressing member configured to press the cleaning unit to the photoreceptor; and at least one second pressing unit configured to press the cleaning unit toward an opposite direction to a direction in which the first pressing member presses the cleaning unit, wherein the second assembly is installed at the first assembly to pivot between a first position to clean the photoreceptor through the cleaning unit and a second position to separate the second frame from the first frame.

15. The image forming apparatus of claim 14, wherein pressure applied by the first pressing member is greater than pressure applied by the second pressing member.

16. The image forming apparatus of claim 15, wherein the second frame comprises a waste toner housing part into which waste toner removed from the photoreceptor by the cleaning unit flows, wherein the cleaning unit is installed at the second frame to pivot between an open position to open the waste toner housing part and a closed position to close the waste toner housing part.

17. The image forming apparatus of claim 16, wherein the cleaning unit is disposed in the open position when the second assembly is in the first position and is disposed in the closed position when the second assembly is in the second position.

18. The image forming apparatus of claim 16, wherein when the second assembly is disposed in the first position, the first pressing member presses the cleaning unit toward the open position, and the second pressing member presses the cleaning unit toward the closed position.

* * * * *